US012601536B2

(12) United States Patent
Cui et al.

(10) Patent No.: US 12,601,536 B2
(45) Date of Patent: Apr. 14, 2026

(54) REFRIGERATOR

(71) Applicants: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

(72) Inventors: Zhanpeng Cui, Qingdao (CN); Jiaming Li, Qingdao (CN); Lisheng Ji, Qingdao (CN); Peng Lv, Qingdao (CN)

(73) Assignees: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 360 days.

(21) Appl. No.: 18/025,236

(22) PCT Filed: Aug. 26, 2021

(86) PCT No.: PCT/CN2021/114766
§ 371 (c)(1),
(2) Date: Mar. 8, 2023

(87) PCT Pub. No.: WO2022/057590
PCT Pub. Date: Mar. 24, 2022

(65) Prior Publication Data

US 2024/0011699 A1 Jan. 11, 2024

(30) Foreign Application Priority Data

Sep. 15, 2020 (CN) ..... 202010970307.X

(51) Int. Cl.
*F25D 17/06* (2006.01)
*F25D 17/04* (2006.01)
*F25D 23/02* (2006.01)

(52) U.S. Cl.
CPC ..... *F25D 23/025* (2013.01); *F25D 17/045* (2013.01); *F25D 17/06* (2013.01); *F25D 2323/023* (2013.01)

(58) Field of Classification Search
CPC ..... F25D 17/045; F25D 17/06; F25D 23/025; F25D 2323/023; F25B 21/02;
(Continued)

(56) References Cited

U.S. PATENT DOCUMENTS 7,451,603 B2 * 11/2008 Tuszkiewicz ..... A47F 3/0408 62/291
7,918,092 B2 * 4/2011 Lin ..... F25B 21/02 62/3.3
(Continued)

FOREIGN PATENT DOCUMENTS

CN 102230713 A 11/2011
CN 102947657 A 2/2013
(Continued)

OTHER PUBLICATIONS

EPO, "Supplementary European Search Report for EP Application No. 21868418.1", Hague, Germany, Dec. 27, 2023.
(Continued)

*Primary Examiner* — Filip Zec
(74) *Attorney, Agent, or Firm* — troutman pepper locke; Tim Tingkang Xia, Esq.

(57) ABSTRACT

A refrigerator, comprising a refrigerator body, a front side of which opens to define a first chamber; a door body, comprising a main door and a secondary door, the main door being used to open/close the first chamber and defining a
(Continued)

second chamber, and the secondary door being used to open/close the second chamber; and a semiconductor refrigeration component, comprising a cold end and a hot end, and configured to enable the cold end to provide cold energy to the second chamber. According to the refrigerator of the present invention, the temperature inside the chamber in the door body can be independently controlled.

8 Claims, 4 Drawing Sheets

(58) Field of Classification Search
CPC ..... F25B 2321/0212; F25B 2321/0252; F25B 2700/2104
See application file for complete search history.

(56) References Cited

U.S. PATENT DOCUMENTS

| | | | | |
|---|---|---|---|---|
| 8,468,837 | B2 * | 6/2013 | Pinet | F25B 21/02 62/412 |
| 9,231,701 | B2 * | 1/2016 | Godali | H05K 7/20136 |
| 10,036,581 | B1 * | 7/2018 | Koplow | F25B 21/04 |
| 10,197,309 | B2 * | 2/2019 | Tao | F25D 11/00 |
| 10,401,072 | B2 * | 9/2019 | Lee | F25D 17/065 |
| 11,434,126 | B2 * | 9/2022 | Kim | F25D 31/006 |
| 2012/0096872 | A1 | 4/2012 | Cheong et al. | |
| 2014/0150486 | A1 | 6/2014 | Boarman et al. | |
| 2017/0350636 | A1 * | 12/2017 | Tao | F25D 19/006 |
| 2019/0049168 | A1 | 2/2019 | Boarman et al. | |
| 2020/0240697 | A1 | 7/2020 | Jeong et al. | |
| 2022/0146186 | A1 * | 5/2022 | Yeo | F25D 17/06 |

FOREIGN PATENT DOCUMENTS

| | | | |
|---|---|---|---|
| CN | 104654849 | A | 5/2015 |
| CN | 106338171 | A | 1/2017 |
| CN | 106369913 | A | 2/2017 |
| CN | 213778313 | U | 7/2021 |
| KR | 20190073837 | A | 6/2019 |
| WO | 2018040442 | A1 | 3/2018 |

OTHER PUBLICATIONS

Chinese Intellectual Property Office (ISR/CN), "International Search Report for PCT/CN2021/114766", China, Oct. 26, 2021.
SIPO, "1st CN Office Action and Search Report for CN Application No. 202010970307.X", China.

* cited by examiner

REFRIGERATOR

CROSS-REFERENCE TO RELATED PATENT APPLICATION

This application is a U.S. national stage application of PCT Patent Application No. PCT/CN2021/114766 filed Aug. 26, 2021, which claims priority to and the benefit of Chinese Application No. 202010970307.X filed Sep. 15, 2020, which are incorporated herein in their entireties by reference.

FIELD OF THE INVENTION

The present invention relates to the technical field of refrigeration and freezing, and in particular to a refrigerator.

BACKGROUND OF THE INVENTION

With the advancement of technology and the improvement of people's living standards, users have higher and higher requirements for refrigerators. The traditional refrigerators with only a refrigerating room, a freezing room and a temperature-variable room can no longer meet users' diverse needs for storage space.

In recent years, a composite door body technology has emerged in the field of refrigerators. As is well-known to all, a traditional refrigerator door body is used to open and close a refrigeration chamber of a refrigerator body. At most, a bottle holder is disposed at an inner lining of the refrigerator door body for placing bottled articles. As for the refrigerator with the composite door body, the structure and functions of the door body are improved, which makes the door body include a main door and a secondary door, and enables the main door to be used for opening and closing the refrigeration chamber. In addition, the main door defines a door body chamber with an open front side, and the secondary door is used to open and close the door body chamber. The secondary door remains closed during rotation of the main door. The door body chamber can be used for placement of stored articles, and only the secondary door needs to be opened when taking and placing the stored articles, without opening the main door. It not only makes the operation more convenient and faster, but also avoids excessive cold energy loss caused by frequent opening of the main door.

However, the refrigerator with the composite door in the prior art also has many defects. For example, in the prior art, the cold air in a first chamber is usually conveyed into a second chamber to refrigerate the second chamber. In this way, the temperature of the second chamber is affected by the first chamber, and it is easy to cause problems such as tainting by other odor. These problems will have a negative impact on user experience and hinder the further development of the composite door refrigerator technology.

BRIEF DESCRIPTION OF THE INVENTION

An object of the present invention is to solve at least one of the above-mentioned defects existing in the prior art, and provide a refrigerator capable of independently controlling the temperature inside a door body chamber.

Another object of the present invention is to solve the problem of tainting by other odor between the door body chamber and a refrigerator body chamber.

Another object of the present invention is to improve the energy efficiency of a semi conductor refrigeration component.

In particular, the present invention provides a refrigerator, including:

- a refrigerator body, a front side of which is open to define a first chamber;
- a door body, including a main door and a secondary door, the main door being used for opening and closing the first chamber and defining a second chamber, and the secondary door being used for opening and closing the second chamber; and
- a semiconductor refrigeration component, including a cold end and a hot end, and configured to enable the cold end to provide cold energy to the second chamber.

Optionally, the semiconductor refrigeration component is disposed outside the second chamber.

Optionally, a refrigerating cavity is formed at the cold end, and the cold end refrigerates the air in the refrigerating cavity; and the refrigerator further includes a cold-end air supply path, which communicates the refrigerating cavity and the second chamber, and is used for conveying the cold air produced by the cold end to the second chamber.

Optionally, the refrigerator further includes a cold-end air return path, which communicates the second chamber and the refrigerating cavity so that air in the second chamber flows back to the refrigerating cavity through the cold-end air return path, is refrigerated by the cold end to form the cold air, and then enters the cold-end air supply path.

Optionally, the refrigerator further includes a first fan, which is disposed in the cold-end air supply path to promote the cold air of the cold-end air supply path to flow toward the second chamber.

Optionally, two ventilation openings are formed in a rear wall of the main door, and the refrigerator is configured as follows: when the main door is closed, ports of the cold-end air supply path and the cold-end air return path are separately hermetically connected to one of the ventilation openings so as to transmit air flow with the second chamber; and when the main door is opened, the two ventilation openings are kept away from the ports of the cold-end air supply path and the cold-end air return path.

Optionally, a cooling cavity is formed at the hot end, and air in the cooling cavity is used for cooling the hot end; and the refrigerator further includes a hot-end air outlet path, which communicates the cooling cavity and a cooling room of the refrigerator for producing cold air, and is used for conveying the air heated by the hot end to the cooling room.

Optionally, the refrigerator further includes: a hot-end air inlet path, which communicates the cooling room and the cooling cavity so that air in the cooling room enters the cooling cavity through the hot-end air inlet path to cool the hot end, and then returns to the cooling room through the hot-end air outlet path.

Optionally, the refrigerator further includes: a second fan, disposed in the hot-end air inlet path to promote cold air in the cooling room to flow toward the cooling cavity.

Optionally, the first chamber is a refrigerating room, and the cooling room is disposed behind the refrigerating room.

The refrigerator provided by the present invention is a refrigerator with a composite door. The door body includes a main door and a secondary door, where the main door is used for opening or closing the first chamber defined by the refrigerator body, and the secondary door is used for opening or closing the second chamber defined by the main door. According to the present invention, the semiconductor refrigeration component is specially disposed to refrigerate the second chamber separately, so that the temperature of the second chamber is independently controllable and not affected by the first chamber. As a result, the second chamber can have a storage environment completely different from the first chamber, and the temperature of the second chamber can be higher than or lower than that of the first chamber. Moreover, there is no air exchange between the second chamber and the first chamber, so that the second chamber can be specially used to store some special articles that are not suitable for being stored in the temperature range of the first chamber.

Furthermore, since the second chamber does not need to introduce cold air from the first chamber for cooling, the first chamber and the second chamber are isolated from each other, and the problem of tainting by other odor in the two chambers is also avoided.

Further, according to the refrigerator provided by the present invention, the semiconductor refrigeration component is disposed outside the second chamber. In this way, on the one hand, it does not occupy the limited storage space in the second chamber, and on the other hand, it is also conducive to heat dissipation at the hot end of the semiconductor refrigeration component.

Further, the refrigerator provided by the present invention is provided with the cold-end air supply path and the cold-end air return path, which are both communicated with the refrigerating cavity at the cold end and the second chamber. The cold air formed by refrigerating the air in the refrigerating cavity at the cold end enters the second chamber through the cold-end air supply path, refrigerates the second chamber, leading to rising of the temperature of the cold air, flows back to the refrigerating cavity from the cold-end air return path, is refrigerated at the cold end again, and then enters the cold-end air supply path again. As a result, the air circulates in the refrigerating cavity, the cold-end air supply path, the second chamber and the cold-end air return path, thus forming an efficient cooling cycle, and accelerating the refrigeration speed of the second chamber.

Further, the refrigerator provided by the present invention is provided with the hot-end air outlet path, and the air heated by the hot end is delivered to the cooling room of the refrigerator. In this way, not only is the heat at the hot end discharged outside in time to prevent the heat from affecting the normal refrigeration for all chambers of the refrigerator body and the normal operation of the semiconductor refrigeration component, but the hot air is also directly transported back to the cooling room instead of an air duct of the refrigerator, which avoids the hot air entering all the chambers of the refrigerator body again through the air duct.

In addition, the present invention is also provided with the hot-end air inlet path, and makes the hot-end air inlet path and the hot-end air outlet path both communicate with the cooling cavity at the hot end. That is, the cold air of the cooling room is introduced through the hot-end air inlet path to cool the hot end, and the hot air formed by heating at the hot end returns to the cooling room again through the hot-end air outlet path, which avoids the hot air affecting refrigeration for all the chambers of the refrigerator body. In short, the present invention uses the cold air of the cooling room to cool the hot end, so that the hot end is cooled faster, the energy efficiency of the semiconductor refrigeration component is improved, and the refrigerating capacity of the cold end is higher.

Further, according to the refrigerator provided by the present invention, the two ventilation openings are formed in the rear wall of the main door; when the main door is closed, ports of the cold-end air supply path and the cold-end air return path are separately hermetically connected to one of the ventilation openings so as to transmit the air flow with the second chamber through the two ventilation openings (i.e., the cold-end air supply path provides the cold air to the second chamber through one ventilation opening, and the air in the second chamber flows back to the cold-end air return path through the other ventilation opening). When the main door is opened, the two ventilation openings are kept away from the ports of the cold-end air supply path and the cold-end air return path (there is no fixed connection relationship, and opening the door will cause disconnection). Such a structure is very simple, there is no need to embed any pipeline in a wall body of the main door, and it does not affect the opening and closing of the main door at all.

The above and other objectives, advantages, and features of the present invention will be better understood by those skilled in the art according to the following detailed description of specific embodiments of the present invention in conjunction with the accompanying drawings.

BRIEF DESCRIPTION OF THE DRAWINGS

In the following part, some specific embodiments of the present invention will be described to in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In the drawings.

DETAILED DESCRIPTION

A refrigerator according to an embodiment of the present invention will be described below with reference to FIGS. 1 to 4. The orientations or positional relationships indicated by "front," "rear," "upper," "lower," "top," "bottom," "inside," "outside," "transverse," etc. are based on the orientations or positional relationships shown in the accompanying drawings, only for the convenience of describing the present invention and simplifying the description, rather than indicating or implying that a device or an element referred to must has a particular orientation, and be constructed and operated in the particular orientation, and therefore cannot be construed as a limitation of the present invention.

Figure 1:
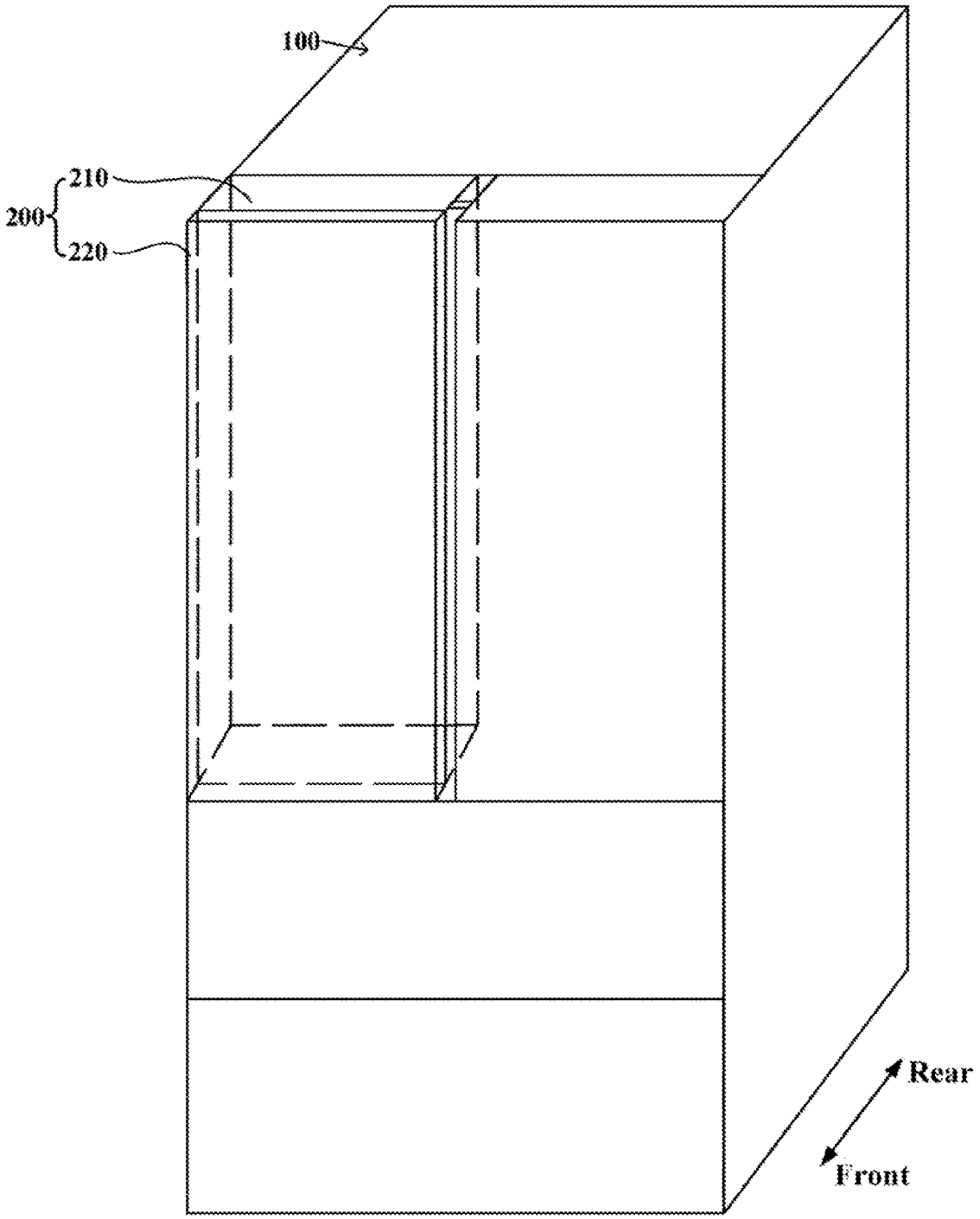
FIG. 1 is a schematic diagram of a structure of a refrigerator according to an embodiment of the present invention.
Figure 2:
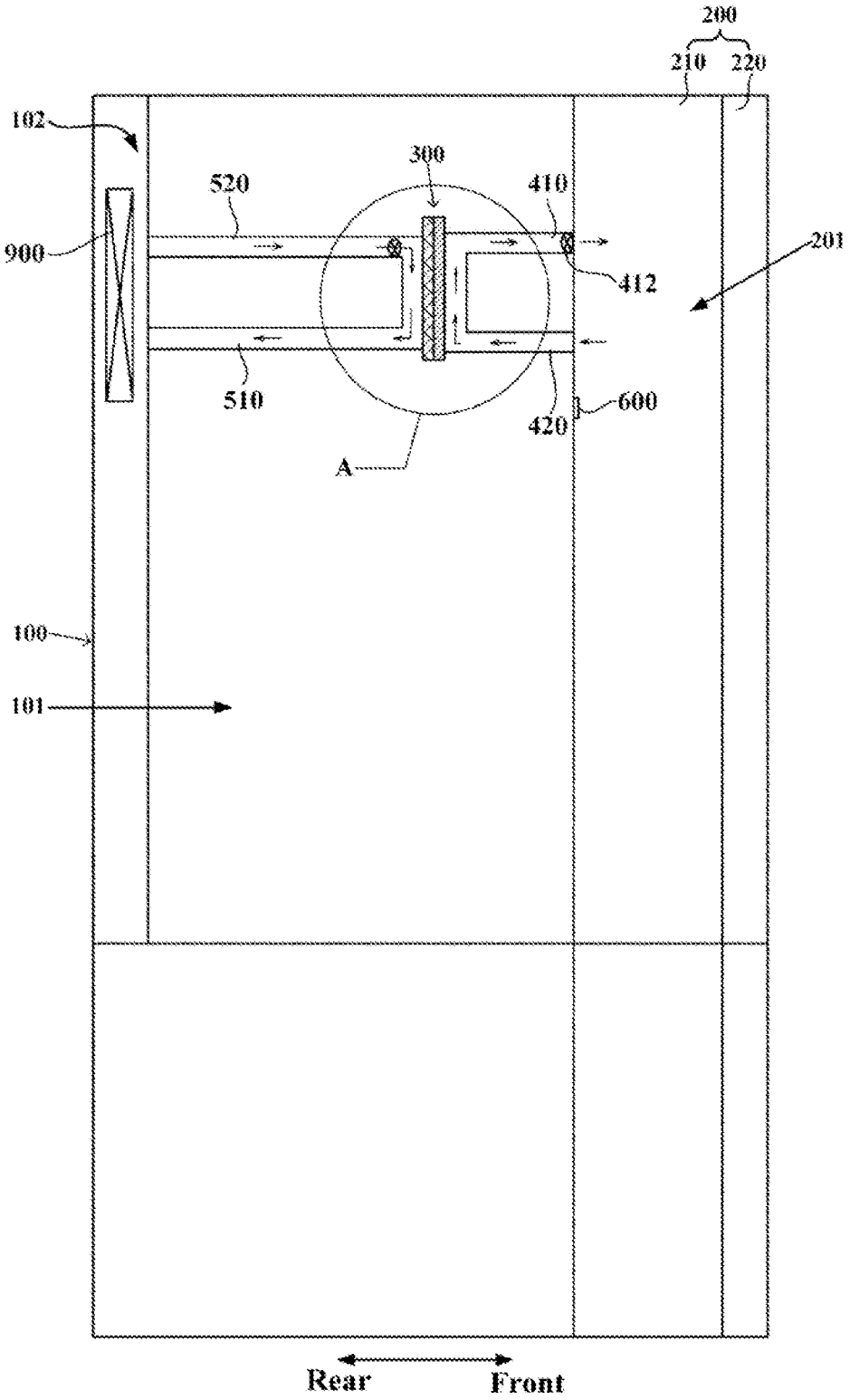
FIG. 2 is a schematic diagram of an air path circulation of the refrigerator shown in FIG. 1.
Figure 3:
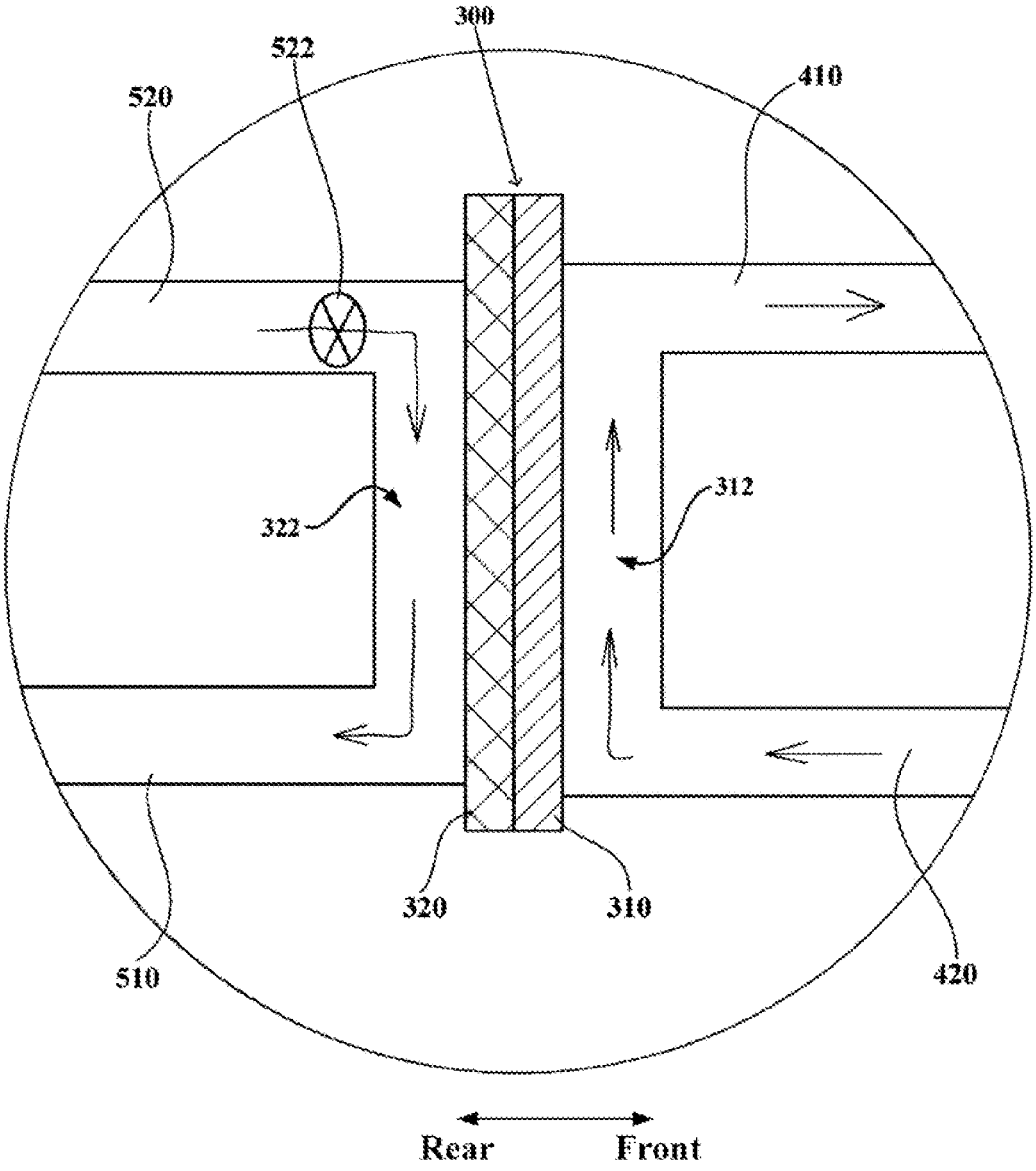
FIG. 3 is an enlarged view at A in FIG. 2.
Figure 4:
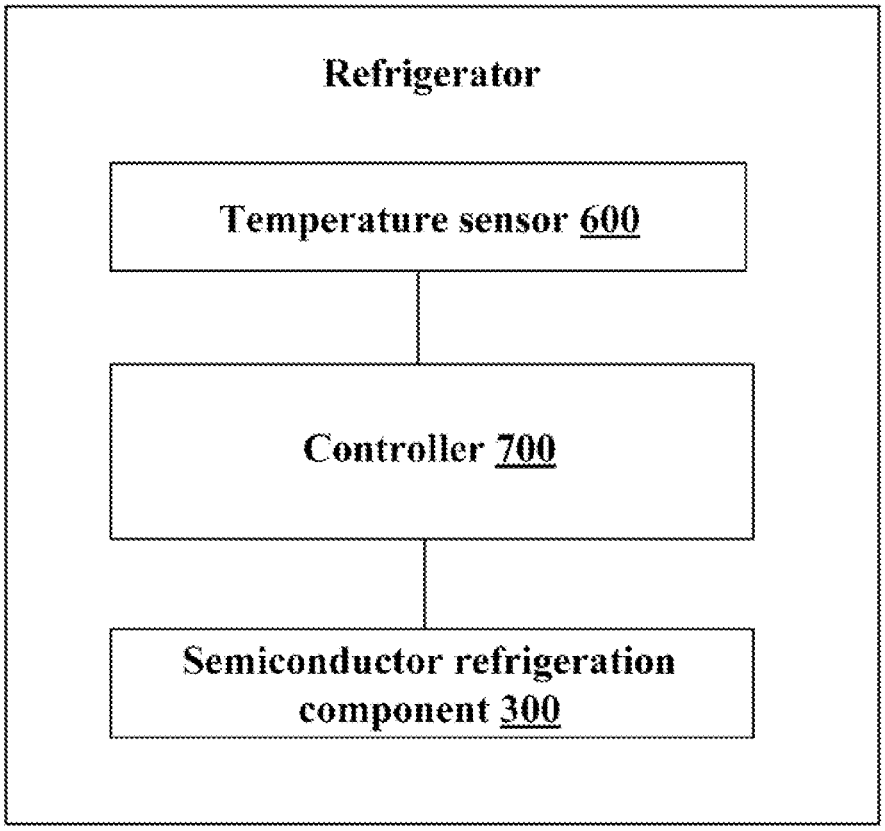
FIG. 4 is a schematic block diagram of a refrigerator according to an embodiment of the present invention.

FIG. 1 is a schematic diagram of a structure of a refrigerator according to an embodiment of the present invention; FIG. 2 is a schematic diagram of an air path circulation of the refrigerator shown in FIG. 1, and the air directions are indicated by arrows in the figures; FIG. 3 is an enlarged view at A in FIG. 2; and FIG. 4 is a schematic block diagram of a refrigerator according to an embodiment of the present invention.

As shown in FIGS. 1 to 4, the refrigerator according to the embodiment of the present invention may generally include a refrigerator body 100, a door body 200 and a semiconductor refrigeration component. A front side (the side where the door body 200 is located is used as the front side of the refrigerator provided by the present invention, and the front and rear directions have been shown in the figures) of the refrigerator body 100 is open to define a first chamber 101. The door body includes a main door 210 and a secondary door 220, where the main door 210 is used for opening and closing the first chamber 101, and defining a second chamber 201, and the secondary door 220 is used for opening and closing the second chamber 201.

The main door 210 can be rotatably installed on the refrigerator body 100 at the front side of the refrigerator body 100, a front side of the main door 210 is open to define the aforementioned second chamber 201, and the secondary door 220 can be rotatably installed on the main body 210 at the front side of the main door 210. When the main door 210 is opened, a user accesses articles from the first chamber 101. When the main door 210 is closed and the secondary door 220 is opened, the user can access articles from the second chamber 201.

The semiconductor refrigeration component 300 includes a cold end 310 and a hot end 320. The semiconductor refrigeration component 300 utilizes the thermoelectric effect of a semiconductor to produce cold energy. After the semiconductor refrigeration component 300 is powered on, the temperature of the cold end 310 decreases, and the temperature of the hot end 320 increases. The semiconductor refrigeration component 300 is configured such that the cold end 310 provides cold energy to the second chamber 201.

According to the embodiment of the present invention, the semiconductor refrigeration component 300 is specially disposed to refrigerate the second chamber 201 separately, so that the temperature of the second chamber 201 is independently controllable and not affected by the first chamber 101. As a result, the second chamber 201 can have a storage environment completely different from the first chamber 101, and the temperature of the second chamber 201 can be higher than or lower than that of the first chamber 101. Moreover, it is not necessary to use the cold air in the first chamber 101 for refrigeration, so that there is no air exchange between the second chamber 201 and the first chamber 101, which enables the second chamber to be specially used to store some special articles, such as medicines and cosmetics, that are not suitable for being stored in the temperature range of the first chamber 101. Furthermore, since the second chamber 201 does not need to introduce cold air from the first chamber 101 for refrigeration, and the first chamber and the second chamber are isolated from each other, the problem of tainting by other odor in the two chambers is also avoided.

As shown in FIGS. 2 and 4, the refrigerator may include a temperature sensor 600 and a controller 700. The temperature sensor 600 is used for detecting the temperature of the second chamber 201, and the controller 700 is used for receiving detection signals of the temperature sensor 600 and controlling a running state of the semiconductor refrigeration component 300 according to the temperature of the second chamber 201. The running state of the semiconductor refrigeration component 300 includes starting and stopping timing, running time, etc., so as to finally realize the adjustment of the refrigerating capacity of the second chamber 201.

In some embodiments, as shown in FIG. 2, the semiconductor refrigeration component 300 may be disposed outside the second chamber 201. For example, it can be installed on the refrigerator body 100. In this way, on the one hand, it does not occupy the limited storage space of the second chamber 201, and on the other hand, it is beneficial to the heat dissipation of the hot end 320 of the semi conductor refrigeration component 300.

In some embodiments, as shown in FIGS. 2 and 3, a refrigerating cavity 312 is formed at the cold end 310 of the semiconductor refrigeration component 300, and the cold end 310 refrigerates air in the refrigerating cavity 312. The refrigerator further includes a cold-end air supply path 410, which communicates the refrigerating cavity 312 and the second chamber 201, and is used for conveying the cold air produced by the cold end 310 to the second chamber 201.

Preferably, the refrigerator may further include a cold-end air return path 420. The cold-end air return path 420 communicates the second chamber 201 and the refrigerating cavity 312 so that the air in the second chamber 201 flows back to the refrigerating cavity 312 through the cold-end air return path 420, is refrigerated by the cold end 310 to form cold air, and then enters the cold-end air supply path 410 again.

Thus, a complete cooling cycle of the second chamber 201 is formed as follows: cold air formed by refrigerating the air in the refrigerating cavity 312 at the cold end 310 enters the second chamber 201 through the cold-end air supply path 410, refrigerates the second chamber 201, leading to rising of the temperature of the cold air, flows back to the refrigerating cavity 312 from the cold-end air return path 420, is refrigerated at the cold end 310 again, and then enters the cold-end air supply path 410 again. As a result, the air circulates in the refrigerating cavity 312, the cold-end air supply path 410, the second chamber 201 and the cold-end air return path 420, thus forming an efficient cooling cycle, and accelerating the refrigeration speed of the second chamber 201.

The refrigerator may further include a first fan 412, and the first fan 412 is disposed in the cold-end air supply path 410 to promote cold air of the cold-end air supply path 410 to flow toward the second chamber 201. The first fan 412 realizes the forced circulation of air flow, and accelerates the operation speed of the cooling cycle.

In some embodiments, two ventilation openings (not shown) may be formed in the rear wall of the main door 210. Furthermore, the refrigerator is configured as follows: when the main door 210 is closed, ports of the cold-end air supply path 410 and the cold-end air return path 420 are separately hermetically connected to one of the ventilation openings so as to transmit the air flow with the second chamber 201 (i.e., the cold-end air supply path 410 provides the cold air to the second chamber 210 through one ventilation opening, and the air in the second chamber 201 flows back to the cold-end air return path 420 through the other ventilation opening). When the main door is opened, the two ventilation openings are kept away from the ports of the cold-end air supply path 410 and the cold-end air return path 420 (there is no fixed connection relationship, and opening the door will cause disconnection). Such a structure is very simple, there is no need to embed any pipeline in a wall body of the main door 210, and it does not affect the opening and closing of the main door 210 at all. The ports of the cold-end air supply path 410 and the cold-end air return path 420 may be located on a side wall or top wall of the first chamber 101 and open forward so as to face the ventilation openings formed in the rear wall of the main door 210 when the door is closed.

In some alternative embodiments, the cold-end air supply path 410 and the cold-end air return path 420 can also directly extend into an interior of the main door 210. The extending portions thereof may be close to a hinged end of the main door 210, and may be set as deformable pipelines such as hoses so as not to affect the pivoting of the main door 210.

In some embodiments, as shown in FIGS. 2 and 3, a cooling cavity 322 is formed at the hot end 320 of the semiconductor refrigeration component 300, and air in the cooling cavity 322 is used for cooling the hot end 320 so as to ensure heat dissipation of the hot end 320, and enable the semiconductor refrigeration component 300 to work normally. Furthermore, the refrigerator further includes a hot-end air outlet path 510. The hot-end air outlet path 510 communicates the cooling cavity 322 and a cooling room 102 of the refrigerator for producing cold air, and is used for conveying the air heated by the hot end 320 to the cooling room 102. In this way, not only is the heat at the hot end 320 discharged outside in time to prevent the heat from affecting the normal refrigeration for all chambers of the refrigerator body and the normal operation of the semiconductor refrigeration component 300, but the hot air is also directly transported back to the cooling room 102 instead of an air duct of the refrigerator, which avoids the hot air entering all the chambers of the refrigerator body 100 again through the air duct.

Further, in some embodiments, the refrigerator further includes a hot-end air inlet path 520. The hot-end air inlet path 520 communicates the cooling room 102 and the cooling cavity 322 so that the air in the cooling room 102 enters the cooling cavity 322 through the hot-end air inlet path 520 to cool the hot end 320, and then returns to the cooling room 102 through the hot-end air outlet path 510. That is, the cold air of the cooling room 102 is introduced through the hot-end air inlet path 520 to cool the hot end 320, and the hot air formed by heating at the hot end 320 returns to the cooling room 102 again through the hot-end air outlet path 510, which avoids the hot air affecting refrigeration for all the chambers of the refrigerator body 100. In short, the present invention particularly uses the cold air of the cooling room 102 to cool the hot end 320, so that the hot end 320 is cooled faster, the energy efficiency of the semiconductor refrigeration component 300 is improved, and the refrigerating capacity of the cold end 310 is higher.

The refrigerator may further include a second fan 522, and the second fan 522 is disposed in the hot-end air inlet path 520 to promote cold air in the cooling room 102 to flow toward the cooling cavity 322, so as to realize the forced flow of the air flow in the hot-end air inlet path 520, accelerate the heat dissipation speed of the hot end 320, and improve the energy efficiency of the semiconductor refrigerating capacity.

The whole refrigerator can be refrigerated by means of a vapor compression refrigeration cycle system, and an evaporator 900 is disposed in the cooling room 102. According to the different refrigeration temperatures, all the chambers inside the refrigerator can be divided into a refrigerating room, a freezing room and a temperature-variable room. For example, the temperature in the refrigerating room is generally controlled within a range of 2° C. to 10° C., preferably 4° C. to 7° C. The temperature range in the freezing room is generally controlled at −22° C. to −14° C. The temperature-variable room can be adjusted within a temperature range of −18° C. to 8° C. to achieve a variable temperature effect. Different types of articles are different in optimal storage temperatures and storage chambers suitable for storage. For example, fruit and vegetable foods are suitable for storage in the refrigerating room, and meat foods are suitable for storage in the freezing room.

The first chamber 101 in the embodiment of the present invention is preferably a refrigerating room. The cooling room 102 is preferably disposed behind the first chamber 101 to be closer to the first chamber 101 so as to facilitate communication with the semiconductor refrigeration component 300. The semiconductor refrigeration component 300, the cold-end air supply path 410, the cold-end air return path 420, the hot-end air outlet path 510 and the hot-end air inlet path 520 can be abutted against the inner wall of the first chamber 101 or embedded in the wall body of the inner wall of the first chamber 101.

Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

What is claimed is:

1. A refrigerator, comprising:

a refrigerator body, a front side of which is open to define a first chamber;

a door body, comprising a main door and a secondary door, the main door being used for opening and closing the first chamber and defining a second chamber, and the secondary door being used for opening and closing the second chamber; and a semiconductor refrigeration component, comprising a cold end and a hot end, and configured to enable the cold end to provide cold energy to the second chamber, wherein the semiconductor refrigeration component is disposed outside the second chamber;

wherein a cooling cavity is formed at the hot end, and air in the cooling cavity is used for cooling the hot end; and the refrigerator further comprises:

a hot-end air outlet path, which communicates the cooling cavity and a cooling room of the refrigerator, and is used for conveying the air heated by the hot end to the cooling room, wherein an evaporator is disposed in the cooling room for producing cold air; and a hot-end air inlet path, which communicates the cooling room and the cooling cavity so that air in the cooling room enters the cooling cavity through the hot-end air inlet path to cool the hot end, and then returns to the cooling room through the hot-end air outlet path.

2. The refrigerator according to claim 1, wherein a refrigerating cavity is formed at the cold end, and the cold end refrigerates air in the refrigerating cavity; and the refrigerator further comprises a cold-end air supply path, which communicates the refrigerating cavity and the second chamber, and is used for conveying cold air produced by the cold end to the second chamber.

3. The refrigerator according to claim 2, further comprising:

a cold-end air return path, which communicates the second chamber and the refrigerating cavity so that air in the second chamber flows back to the refrigerating cavity through the cold-end air return path, is refrigerated by the cold end to form the cold air, and then enters the cold-end air supply path.

4. The refrigerator according to claim 2, further comprising:

a first fan, disposed in the cold-end air supply path to promote the cold air of the cold-end air supply path to flow toward the second chamber.

5. The refrigerator according to claim 4, wherein two ventilation openings are formed in a rear wall of the main door, and the refrigerator is configured as follows:

when the main door is closed, ports of the cold-end air supply path and the cold-end air return path are separately hermetically connected to one of the ventilation openings so as to transmit air flow with the second chamber; and when the main door is opened, the two ventilation openings are kept away from the ports of the cold-end air supply path and the cold-end air return path.

6. The refrigerator according to claim 1, further comprising:

a second fan, disposed in the hot-end air inlet path to promote cold air in the cooling room to flow toward the cooling cavity.

7. The refrigerator according to claim 1, wherein the cooling room is disposed behind the first chamber.

8. The refrigerator according to claim 7, wherein the first chamber is a refrigerating room.

* * * * *